US008376134B1

(12) United States Patent
Underwood

(10) Patent No.: US 8,376,134 B1
(45) Date of Patent: Feb. 19, 2013

(54) DRINK BOTTLE WITH MULTIPLE DRINK DOSAGE DEVICE

(76) Inventor: Philip Andrew Underwood, Hope Mills, NC (US)

( * ) Notice: Subject to any disclaimer, the term of this patent is extended or adjusted under 35 U.S.C. 154(b) by 0 days.

(21) Appl. No.: 13/474,861

(22) Filed: May 18, 2012

(51) Int. Cl.
*B65D 25/08* (2006.01)

(52) U.S. Cl. ..... 206/221

(58) Field of Classification Search ..... 206/219–221, 206/568; 215/6, DIG. 8; 222/83, 129, 521
See application file for complete search history.

(56) References Cited

U.S. PATENT DOCUMENTS 1,798,339 A 3/1931 Soulis
6,444,174 B1 * 9/2002 Lascombes ..... 206/219
6,705,490 B1 * 3/2004 Lizerbram et al. ..... 206/221
6,945,393 B2 * 9/2005 Cho ..... 206/219
6,959,841 B2 * 11/2005 Vlodek ..... 222/129
8,146,758 B1 * 4/2012 Peres ..... 206/219
2004/0149598 A1 8/2004 Scarla
2004/0262173 A1 12/2004 Buesching et al.
2005/0102978 A1 * 5/2005 Gueret ..... 206/219
2005/0284792 A1 12/2005 Gopinathan
2006/0226035 A1 * 10/2006 Smith et al. ..... 206/219
2009/0178940 A1 * 7/2009 Said ..... 206/221
2010/0181275 A1 7/2010 Gruenwald et al.
2011/0259769 A1 * 10/2011 Salinas ..... 206/219
2012/0024812 A1 2/2012 Underwood
2012/0074003 A1 * 3/2012 Sheehan ..... 206/219

* cited by examiner

*Primary Examiner* — Luan K Bui
(74) *Attorney, Agent, or Firm* — James G. Passé; Passé Intellectual Property, LLC

(57) ABSTRACT

The present invention discloses a bottle for holding a liquid with at least one self dosage compartment for adding a desired solid such as powdered drink mix and the like to liquid such as water in the bottle consisting of a bottom compartment with a top lid and a bottom closure inside the interior space of the bottle to deliver the solid to the liquid and kept in the compartment till user is ready to mix with liquid.

8 Claims, 3 Drawing Sheets

DRINK BOTTLE WITH MULTIPLE DRINK DOSAGE DEVICE

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to a drink bottle. In particular, the present invention relates to a water or other drink bottle with a multiple flavor powder dosage device located at the top of the bottle for flavoring water or other liquid in the bottle.

2. Description of Related Art

The use of flavor, energy, vitamins, medicine, or the like for the addition to bottle of water or other liquid has become increasingly popular. Easy to dissolve powdered additives are added to the liquid rather than a premixed drink purchased at the store such as a cola or other soda type drink. In many cases a powder is premeasured and added to a bottle of liquid or purchased bottle of liquid such as water.

Addition of a powder of some kind adds to the shelf life of virtually all products, but where a product is unstable in liquids such as water, it is practically necessary. Many products degrade over some period of time in water or water based liquids to the point where they lose potency, taste, or the ability to do the job they were intended for. When adding a powder to a bottle, one either has to measure it out or carry a separate premeasured packet. If one is in the middle of an activity that can cause a delay or unwanted interruption in the activity especially, for example, sporting type activities or activities related to young children.

Solid dosage preparations placed on the exterior recessed bottom of open-topped drinking cups or tumblers are known in the art. U.S. Patent Application 2004/0149598 to Scarla, for example, attaches a breath freshener to the bottom of a disposable cup, such as a STARBUCKS™ coffee cup. In U.S. Pat. No. 1,798,339 to Soulis, a tablet, or a powder composition in a pouch is attached to the raised bottom of a paper cup. These containers, however, while temporarily filled for drinking, do not contain the liquid product, in the sense of put-up packaging. Even if they were to be transformed into a shelf package by means of filling and applying a sealing closure, they provide little physical and no safety protection for the solid dosage component, not to mention failing to provide self-stability for the liquid component.

Sealed-closure bottled liquid products, where an adjunct component is conveyed therewith, at or near the bottom, are also known. In U.S. Patent Application 2005/0284792 to Gopinathan, a multi-component migraine kit is stored in a separate container comprising a false bottom to a water bottle. In U.S. Patent Application 2004/0262173 to Buesching, a medication is provided in an end-cap which is press-fit to the posterior of a bottle containing a liquid, such as water. An additional container is required, however, in each of these cases. The additional container represents increased cost and assembly complication. Furthermore, the accompanying product is unprotected with regard to tampering. Still furthermore, the product, in its location underneath the bottle, is not always visible to the consumer of the product.

In US patent application 2010/0181275 to Gruenwald there is a solid dosage preparation with a bottle of water. The solid dosage preparation is contained within a cavity at the bottom of the bottle and held there by a heat sealed lidding. The device is tamper resistant and intended for single use.

In US patent application 2012/0024812 to Underwood there is a design for the addition of powdered liquids to the bottom of the bottle. However, this design has some problems in terms of access to the compartment and the necessity of designing an entirely new bottle design. That is, there is no way to design a version that works with existing bottles not previously equipped.

The art is silent on the availability of a reusable water bottle for dosage of a dissolvable powder in to water within the bottle that overcomes the problems and disadvantages of the previous liquid containing bottles.

BRIEF SUMMARY OF THE INVENTION

The present invention relates to the discovery that by providing a plurality of top loading compartments to a water bottle or other liquid containing device that the particular problems that have been long standing in the art are overcome.

In one embodiment the present invention is a bottle having a top portion outer surface, an interior space for containing a drinking liquid and a bottle cap as part of the outer surface comprising:

a) a plurality of compartments for containing a solid designed to dissolve in a liquid in the bottle interior space, each compartment having a top portion and a bottom portion wherein each compartment has an opening on the top portion positioned on the top portion outer surface of the bottle for addition of the solid to the compartment and has a closable cover on the opening for preventing a solid added to the compartment from spilling out of the compartment; and b) wherein each of the plurality of compartments has a closure in communication with the bottle interior space which can place a solid in the compartment in communication with a liquid in the interior space when the closure is opened.

DETAILED DESCRIPTION OF THE INVENTION

Figure 1:
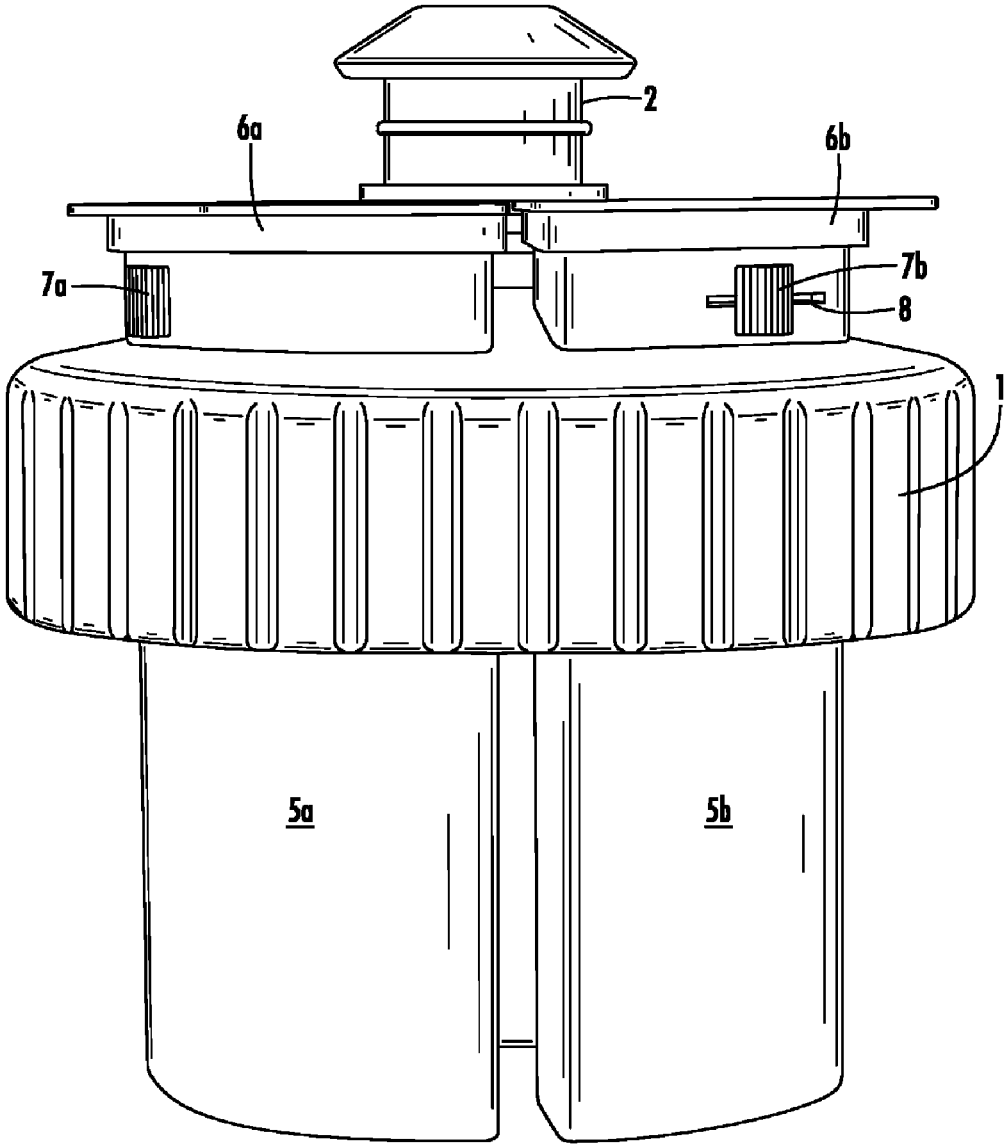
FIG. 1 is a side view of the compartments of the present invention fitted in the cap of a bottle for a liquid.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "about" and "essentially" mean±10 percent.

The term "comprising" is not intended to limit inventions to only claiming the present invention with such comprising language. Any invention using the term comprising could be separated into one or more claims using "consisting" or "consisting of" claim language and is so intended.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "bottle" refers to a container for holding a liquid designed for drinking such as water which has an elongated body with an interior space for placing the liquid. The bottle can be a typical reusable water bottle, a baby bottle or any other reusable type bottle for placing a liquid for drinking. The bottle will also have an exterior surface and a neck portion which may or may not be narrower than the elongated body. The bottle will also have a cap portion covering a top opening where liquid can be added to the bottle and there will be a bottom portion of the interior space. In general water bottles, whether for cycling, exercising, just drinking water, and the like, come primarily in polymeric versions made from materials that are safe to store both water and liquid drink mixes in. That is, the use of "food grade" material is useful. While metal food grade containers such as stainless can also be utilized, when cost is an issue, polymeric containers will normally be the embodiment utilized. Typically, water bottles are utilized just for containing water and if a drink powder is to be used with the water bottle, a dosage of the drink powder is added through the top opening of the bottle unlike the present invention. As used herein the "top portion outer surface" refers to the upper half of the bottle, in one embodiment the upper third, and in another embodiment just the cap. Outer surface has its normal meaning and in general, refers to an area above the liquid in the bottle such that gravity can add a solid to the liquid for suspension or dissolution. The bottle can have a closable drinking spout, for example, as shown in the figures or any kind of mechanism for drinking the liquid in the bottle.

The use of very inexpensive plastics are utilized in the construction of disposable bottles such as water bottles that are thin and designed not to be reused, though most can for a small number of refills. On the other hand, reusable water bottles are made of thicker materials and designed to be washed and reused, for example, can be placed in the dishwasher for cleaning and sterilizing. Those skilled in the art of drinkable liquid bottles can select the most appropriate plastics and construction materials for constructing a bottle of any kind.

As used herein the "compartment" of the present invention is an area large enough to contain a dosage of solid such as a tablet, powder or the like to flavor or dose with a desired consumable like vitamins, food, minerals or the like by dissolving or suspending or the like in a liquid such as water placed in the remainder of the inner space of the bottle. The plurality of compartments each have a top portion and a bottom portion and are positioned within the top portion in the upper half of the bottle, at least a portion of which is on the outer surface and a bottom portion at least a portion positioned in the interior space. In one embodiment the compartments are positioned in the cap of the bottle, for example, as shown in the figures but the cap mounting is not intended to be the only position. The exact position is designed such that one can add the solid to the top portion and the bottom portion of the compartment delivers the solid to the interior space to dissolve or suspend in the liquid in the inner space. The top portion has an opening for addition of the solid to the compartment and a lid to keep it from spilling out after added. The lid can be a snap on type or anything in the art. One skilled in the art of lids could easily design an appropriate lid. The bottom portion has a closure which can be opened or closed in a position in communication with the interior space such that it can deliver the solid to the interior space, in one embodiment by opening and delivering by gravity (as shown in the figures). In one embodiment, the means for opening and closing the closure is on either the compartment top portion or on the outer surface of the bottle. In one embodiment the closure is opened and closed by sliding and a slide mechanism such as a button to open and close the closure, for example, as shown in the figures.

Now referring to the figures, FIG. 1 is a side view of the compartments of the present invention fitted in the cap of a bottle for a liquid. The bottle is removed in this view for clarity. Bottle screw on cap 1 fits on the top of, in this embodiment, a water bottle by screwing or snapping on the bottle opening. The cap 1 also has water bottle drinking spout for opening and closing and taking a drink of water. In this view two of three compartments 5*a* and 5*b* for placing a solid to be placed in the bottle are shown.

Each compartment 5*a* and 5*b* have a removable lid 6*a* and 6*b* which when opened reveals an opening to add the solid. One can then add into each compartment enough of the solid one needs/wishes to add of which ever component is desired to add to the liquid. In one embodiment, each compartment contains a different solid and two or more solids are placed in the interior space at the same time. This is useful when combining ingredients which are not compatible long term with one another.

On the side of compartments 5*a* and 5*b* are slide buttons 7*a* and 7*b* which are used to open the closures at the bottom of the compartments and deliver the solid to the interior space of a bottle. By sliding the buttons using slot 8, one can slide open and closed the enclosure and such mechanism is within the skill in the art in view of this disclosure and drawings.

Figure 2:
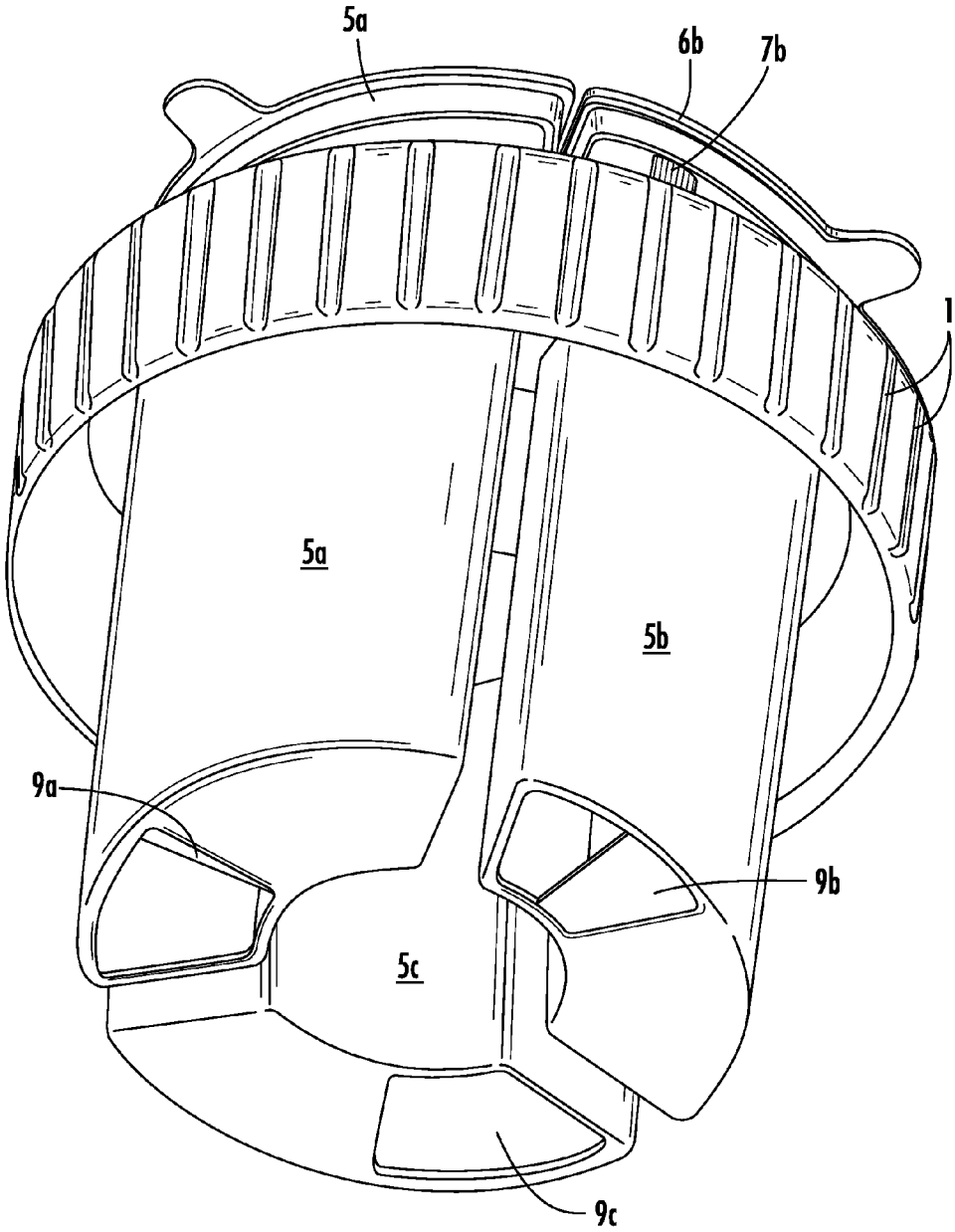
FIG. 2 is a bottom perspective view of the bottom of the compartments showing the closure for delivering the solid to the liquid in the bottle.

FIG. 2 is a bottom perspective view of the bottom of the compartments showing the closure for delivering the solid to the liquid in the bottle. The third compartment 5*c* can be seen in this view. Accordingly, since there are three compartments the user can deliver up to three doses of solid to the bottle. Each of the compartments has a closure 9*a*, 9*b* and 9*c* which are open, partially open and closed respectively in the drawings. When the slide buttons are slide in one direction it opens the closure the other direction closes the closure. Since the closures are on the bottom of the compartment's opening, the closure allows the contents of the compartment to fall by gravity into the interior space assuming the bottle is in the proper upright position.

Figure 3:
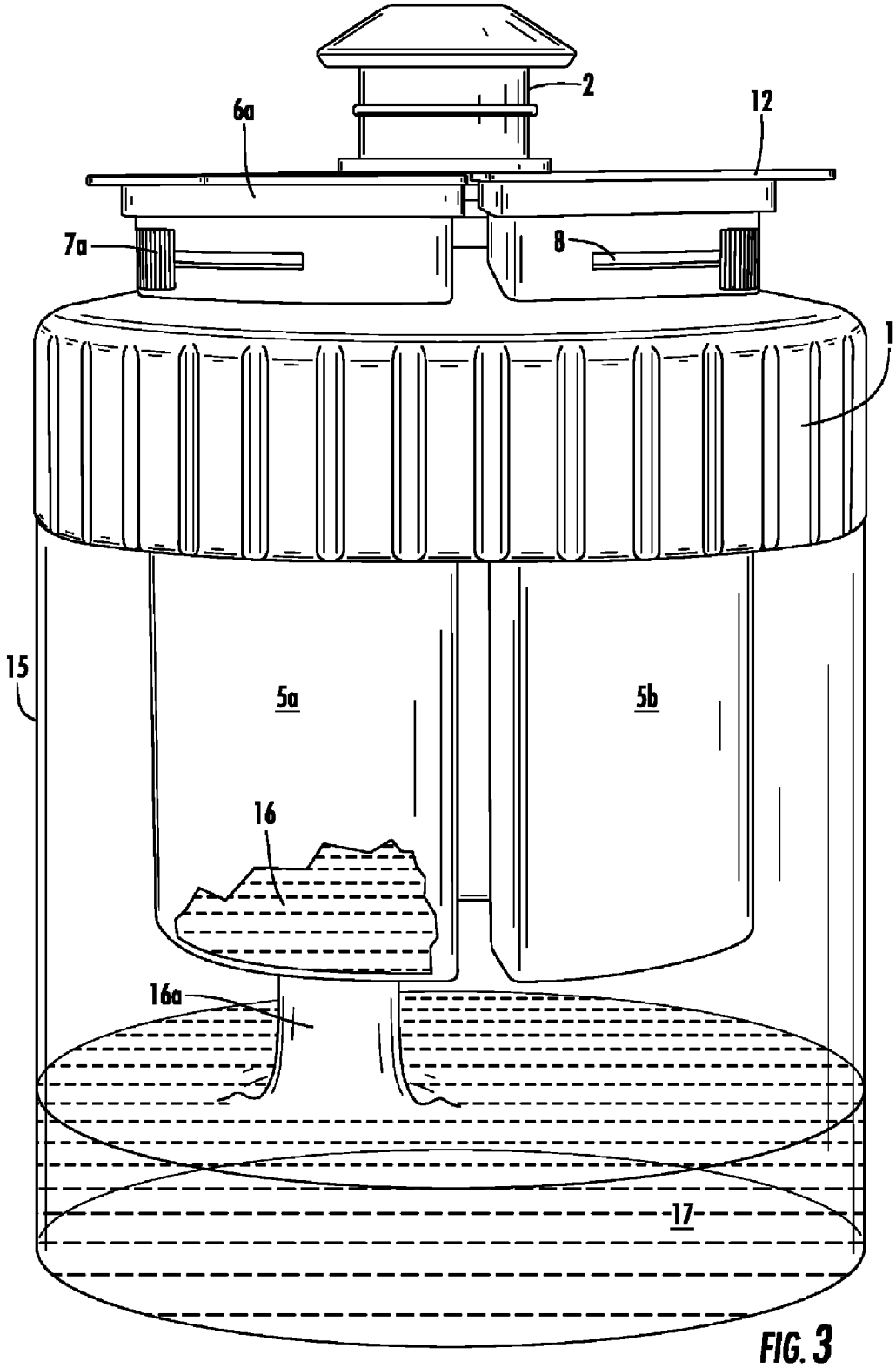
FIG. 3 is a side view of the device in FIG. 1 mounted on a bottle and delivering a solid powder to some liquid in the bottle.

FIG. 3 is a side view of the device in FIG. 1 mounted on a bottle and delivering a solid powder to some liquid in the bottle. Bottle 15 is shown mounted with the cap and compartments of FIG. 1. In this view a powder 16 can be seen in compartment 5*a* and with slide 7*a* in a position which opens the closure powder 16*a* can be seen falling into liquid 17 in the bottle. The powder can then be mixed, for example, by shaking the bottle after the closure is closed insuring no liquid enters the compartment. When the user finishes the liquid, more liquid (e.g. water) can be added to the bottle and another dose of powder from another compartment added. While a water bottle is depicted in the drawings, any type of bottle can be utilized such as a baby bottle or the like.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A bottle having a top portion outer surface, an interior space for containing a drinking liquid and a bottle cap as part of the outer surface comprising:

a) a plurality of compartments for containing a solid designed to dissolve in a liquid in the bottle interior space, each compartment having a top portion and a bottom portion wherein each compartment has an opening on the top portion positioned on the top portion outer surface of the bottle for addition of the solid to the compartment and has a closable cover on the opening for preventing a solid added to the compartment from spilling out of the compartment;

b) wherein each of the plurality of compartments has a closure in the interior ace of the bottle on the bottom portion in communication with the bottle interior space which can place a solid in the compartment in communication with a liquid in the interior space when the closure is opened; and c) a vertically mounted sliding mechanism on a side of the top portion outer surface separate from the closure which slides horizontally for sliding the closure open and closed.

2. The bottle according to claim 1 wherein the compartments are mounted in the bottle cap.

3. The bottle according to claim 1 wherein the compartment can deliver the solid to the interior compartment by gravity when the closure is in an open position.

4. The bottle according to claim 1 wherein the bottle is a reusable water bottle.

5. The bottle according to claim 4 wherein the water bottle has a closable drinking spout.

6. The bottle according to claim 1 which contains a liquid in the interior space and a solid which dissolves in the liquid in at least one of the compartments.

7. The bottle according to claim 6 wherein the solid is a powder.

8. The bottle according to claim 1 wherein each compartment top opening has a closable snap on lid.

* * * * *